US005353211A

United States Patent [19]

Merko

[11] Patent Number: 5,353,211

[45] Date of Patent: Oct. 4, 1994

[54] LIGHT MODIFIER

[76] Inventor: Andrew V. Merko, 1294 Sunny Oaks Cir., Altadena, Calif. 91001

[21] Appl. No.: 93,652

[22] Filed: Jul. 20, 1993

[51] Int. Cl.[5] ..... F21V 29/00

[52] U.S. Cl. ..... 362/294; 362/6; 362/232; 362/275; 362/287; 362/372; 362/373; 362/419

[58] Field of Search ..... 362/3, 6, 11, 16, 232, 362/269, 270, 271, 275, 285, 287, 294, 373, 263, 264, 418, 419, 427, 429, 372

[56] References Cited

U.S. PATENT DOCUMENTS

| | | | |
|---|---|---|---|
| 2,287,328 | 6/1942 | Rose | 362/373 |
| 2,307,301 | 1/1943 | Richardson | 362/373 |
| 3,116,022 | 12/1963 | Davis | 362/294 |
| 4,017,727 | 4/1977 | Yamamoto . | |
| 4,097,919 | 6/1978 | Bobrick et al. | 362/270 |
| 4,141,059 | 2/1979 | Shiojiri | 362/18 |
| 4,190,880 | 2/1980 | Esaki | 362/18 |
| 4,419,716 | 12/1983 | Koo | 362/294 |
| 4,460,942 | 7/1984 | Pizzuti | 362/217 |
| 4,533,984 | 8/1985 | Gatton | 362/232 |

*Primary Examiner*—Ira S. Lazarus
*Assistant Examiner*—Alan B. Cariaso

[57] ABSTRACT

A light modifier for illuminating a subject using a combined modeling/strobe light source as the light source. This light assembly is attached to an adjustable focusing mechanism enabling the light to be projected either as a spot or a flood. The light is intended mainly for professional studio use, and is generally placed away from the camera.

The main body of the light housing is molded of one piece plastic and attached to a yoke assembly by two adjustable knobs which control the vertical rotation of the light. The back of the housing is open with light-baffle plate preventing light from spilling from the rear of the housing, while allowing for free air circulation around the light-baffle plate. The design allows the unit to rotate 360 degrees around the yoke axis. It may be mounted on a light stand, or other support structures such as an overhead rack.

The light is equipped with a fresnel lens molded of transparent plastic having the fresnel facets closely spaced on outside-facing (long conjugate) side. The lens is sand blasted or chemically "frosted" on the inside-facing (short conjugate) side, resulting in a softer, more diffused, light. Because the fresnel facets are shallow in depth and spaced very closely together, the illumination is uniform and free of hot "spots or rings," normally associated with glass fresnel lenses. The lens can be drilled and is joined to the light housing by arrangement of fasteners and spacers, an arrangement which provides for free air circulation around the lens edges.

11 Claims, 5 Drawing Sheets

LIGHT MODIFIER

BACKGROUND OF THE INVENTION

1. Field of the Invention

The present invention relates to a light modifier, used in photography, and more specifically to a light modifier equipped with a frosted fresnel lens, fitted into an all-plastic housing employing longitudinally adjustable combined modeling/strobe light source.

2. Background of the Invention

One of the most important aspects of photography is the ability to control light.

There are two primary artificial lighting techniques used in professional photography: constant light source, or electronic strobe. Of these two methods, the strobe light has gained prominence as the preferred method. This light source is designed for use with films balanced for daylight.

The exposure times for daylight films are generally of short duration, ranging from 1/10 second to 1/10,000 second. This is ideal for situations where fast shutter speeds or short bursts of intense light are required to capture the action or expression. In addition, the strobe light can be mixed with available daylight either as the main source or a filler.

Contemporary studio lighting calls for a strobe light fitted with a relatively low intensity modeling light, around or adjacent to the flash tube. The purpose of the modeling light is for viewing the desired lighting effect, and for focusing and composing. When the camera shutter is tripped, the strobe light is triggered in synchronization with the shutter, and the film is exposed. It is this more powerful strobe light which actually exposes the film.

A typical combined modeling/strobe light source, may be mounted on a variety of reflectors and light modifiers. Most common are simple parabolic reflectors of varying focal lengths and configurations. They generally have polished or dull surfaces designed to direct the light beam. Several designs of "soft boxes" and "bounce umbrellas" are also employed to create a diffused, softer light.

In the "soft box" version the light source is placed inside a fabric box whose framework is usually made of lightweight tubing. It typically has a black, light-tight rear and side panels, and a white, translucent front surface. In the "bounce umbrella" arrangement, the light is pointed into the underside of the umbrella and reflected back into the area to be illuminated. These lights are generally used for broad, soft illumination.

Another method of light control is the so-called theatrical or spot light. In this application the light is installed inside a metal housing, fitted with a heat absorbing fresnel type glass lens. A focusing mechanism allows the light to traverse longitudinally. By moving the light closer to the lens the light beam spreads; conversely, backing the light away from the lens condenses it to a spot.

This design has been used in both still and cinema photography and theatrical productions, essentially unchanged, for the past century. The metal housing is usually equipped with elaborate baffles and venting arrangements in an attempt to get rid of the high heat build-up, and to protect the operator from burns. The light source employed is typically of the tungsten type which uses a high wattage light bulb.

While it is possible to modify this existing technology for still photography, the heavy metal housing, or the heavy fresnel glass, is no longer required or desirable. This old-style spot light has several distinct disadvantages in its present configuration:

The heavy metal construction of the housing, necessary to support the thick glass fresnel lens, makes it cumbersome to transport and handle. To compound the problem, the yoke assembly has to be made correspondingly heavier, to support the weight of the housing.

If accidentally dropped, the glass lens breaks easily.

Because of its weight, the metal light modifier has to be mounted on a heavier, more expensive stand. These motion picture studio stands are not generally found in still photography.

For cosmetic reasons, and to prevent rusting, the metal housing requires a painted finish, inside and out; moreover, it scratches and dents easily.

Sheet metal construction presents severe design limitations, both esthetic and practical, especially for a cylindrical shape design.

Typical glass fresnel lenses have two or three facets per inch, and have a fairly thick cross section. The bulk of the glass between the reflective surfaces has no effect on the optical properties of the lens, however, it will affect the light output due to absorption loss, resulting in less light output for a given light source. Moreover, the widely spaced facets create disturbing, uneven, hot spots and rings on the object being illuminated.

The combination of glass lens and the labor intensive method of manufacturing the metal light housing, results in a very expensive unit. The above cited factors are basically responsible for the limited use of this otherwise excellent light source, by still photographers.

Because the strobe light has become the preferred method of lighting, several attempts have been made to convert the existing tungsten powered theatrical lights for use with a strobe light. However, with the advent of the modern high output flash and low wattage modeling lights, the heat build-up is no longer a problem, hence, there is no reason why both the housing and the lens cannot be replaced with a lightweight, lower cost, plastic components.

Development of an adjustable light modifier, rotatable 360 degrees vertically and horizontally, which is lighter in weight, has a thinner lens, can be easily handled and supported and which does not project rings and hot spots would represent a significant improvement in the field of photographic lighting and would satisfy a long felt need of the studio and location photographers.

SUMMARY OF THE INVENTION

The present invention represents a great improvement in the field of light control and satisfies the need of studio and location photographers for lightweight, sturdy, light source, capable of projecting a soft, direct light beam.

Accordingly it is the primary purpose of this invention to improve the design and manufacture of a light modifier by utilizing an all-plastic light housing, fitted with an all-plastic, frosted, fresnel lens having closely spaced facets. Because of the weight savings, this theatrical or spot light type modifier may be made larger in size than those currently in use by most still photographers. By utilizing plastic molding techniques, even a large light modifier can be made lighter, more uniform in size, and to incorporate several built-in features, difficult or impossible to duplicate in sheet metal.

The all-plastic, molded light housing has many distinct advantages over sheet metal. The molding process allows the housing to be made in virtually any shape, from cylindrical to cubic. The hoop design featured in this invention, is extremely strong, while retaining its lightweight properties. The molded finish of the housing needs no painting or other post-finishing operations. During the molding process, any number of threaded inserts and other components may be incorporated into the housing assembly.

Plastic fresnel lenses enjoy similar advantages over their glass counterparts. They have several times the number of facets per inch, compared to glass. This results in a more uniform light and the elimination of the "rings" and uneven hot spots, common with glass fresnel lenses with their wider spaced, deeper facets. Plastic is easily "frosted" on either side, by chemical or mechanical means, to further soften the light.

Because the plastic lens is only a fraction of the thickness of its glass counterpart, it allows more light to pass through it for more efficient light output. The weight of a typical plastic fresnel lens is about one tenth that of glass.

Unlike the plastic lens, glass lenses break easily when knocked over, and the replacement cost of a large fresnel lens is several times the cost of a plastic lens of the same diameter.

Because of the weight savings, the housing can be made bigger to accommodate a larger diameter lens for brighter, more even light distribution.

Plastic fresnel lenses can be easily drilled, enabling the lens to be mounted with simple spacers between the lens and the front housing flange. This arrangement allows for a free air circulation around the lens, further reducing the modest heat build-up, generated by the low wattage modeling light or the short duration of the strobe light. Because the thin lens is flexible, it is easily curved and slipped inside the plastic housing, through the front opening, allowed to snap back to flat shape, and secured against the front flange with fasteners.

Due to the light weight of the plastic fresnel lens, the light modifier and its support components may be made much lighter, resulting in an easier to handle unit. Because of the weight reduction, the light is easier and cheaper to transport to a location. It may be mounted on a standard light stand, instead of the more expensive and heavier motion picture studio stand.

An appreciation of the other aims and objectives of the present invention and a more complete and comprehensive understanding of it may be achieved by referring to the accompanying drawings and studying the following description of the preferred embodiment.

PART NAMES

Figure 1B:
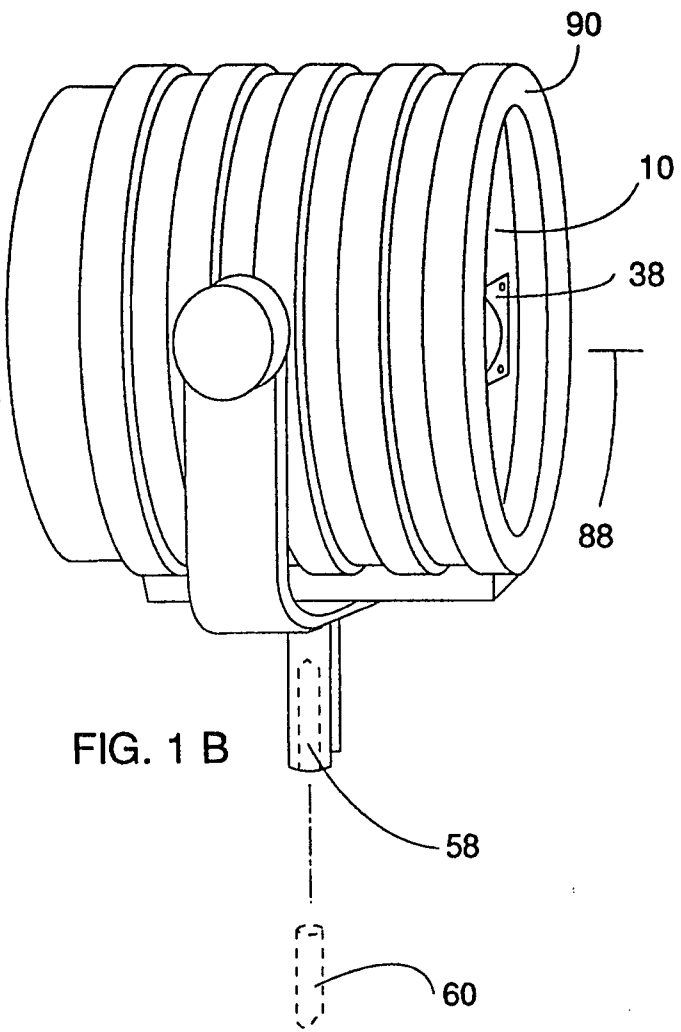
FIGS. 1A and B show a perspective right and left side view of the light modifier, showing the housing; yoke assembly; portion of the fresnel lens; horizontal and vertical adjustment knobs; front and rear flanges; lens mounting fasteners and portions of the light-baffle plate and light adapter plates.

5 Light Modifier
10 Light-baffle plate
12 Light mounting hole
14 Light-baffle plate brackets
16 Carriage plate
18 Traverse rods
20 Brake plate
22 Brake nut
24 Traverse slot
26 Inside base plate
28 Outside base plate
30 Brake washer
32 Brake knob
34 Combined modeling/strobe light source
36 Fastener
38 Light adapter plate
42 Plastic housing
44 Plastic fresnel lens
46 Spacer
48 Hub pressure plate
50 Pressure washer
52 Yoke
54 Vertical adjustment knob
56 Horizontal adjustment knob
58 Yoke attachment receiver
60 Stand
62 U-nut
64 Closed end weld-nut
66 J-nut
68 Clamping screw
70 Clamping screw hole
72 Adaptor plate mounting hole
74 Yoke attachment receiver mounting hole
76 Knob clearance holes
78 Air flow
80 Fastener hole
82 Lens mounting hole
84 Front flange
86 Optional auxiliary fan
88 Longitudinal axis
90 Rear flange
92 Weld-nut threads

DESCRIPTION OF PREFERRED EMBODIMENT

Figure 1A:
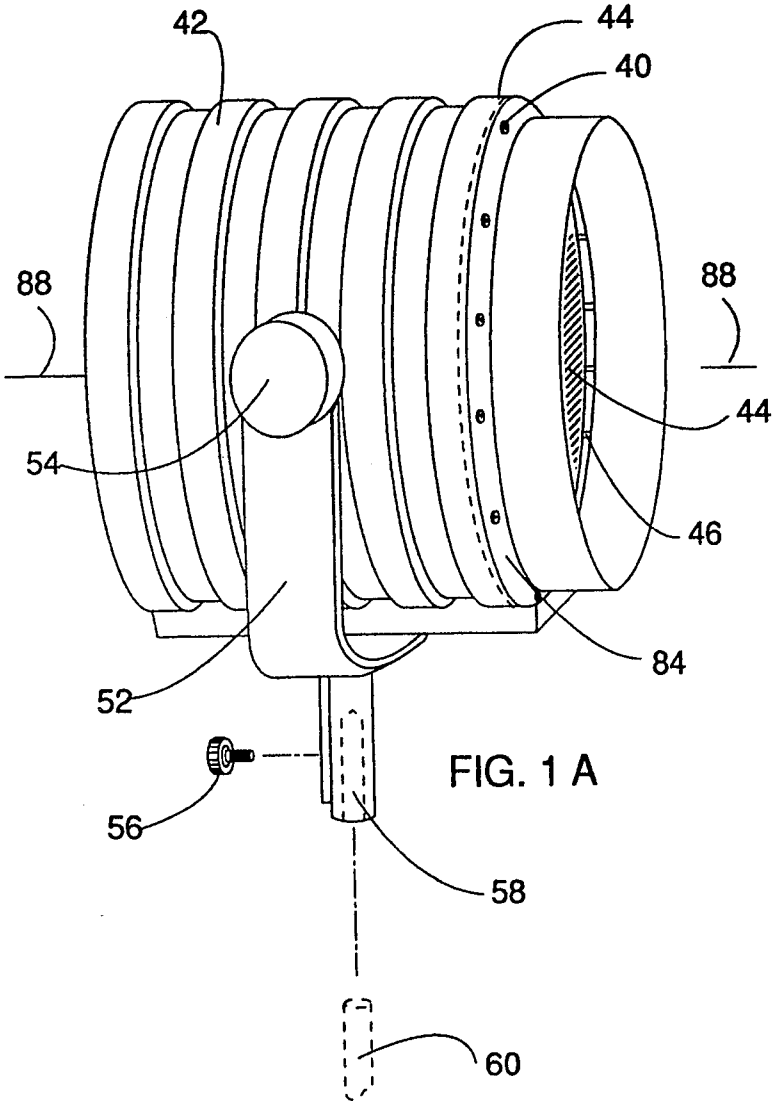

FIGS. 1A and B show a perspective view of the plastic light modifier 5 with its component parts and circumferential ribs: the fresnel lens 44; the yoke 52; the vertical adjustment knob 54; the horizontal adjustment knob 56; the yoke attachment receiver 58; the light stand 60; fasteners 36; the front flange 84; the rear flange 90. The housing 42 is made of high density plastic by molding. The stand 60 is available in several sizes and configurations.

Figures 2, 6, 9:
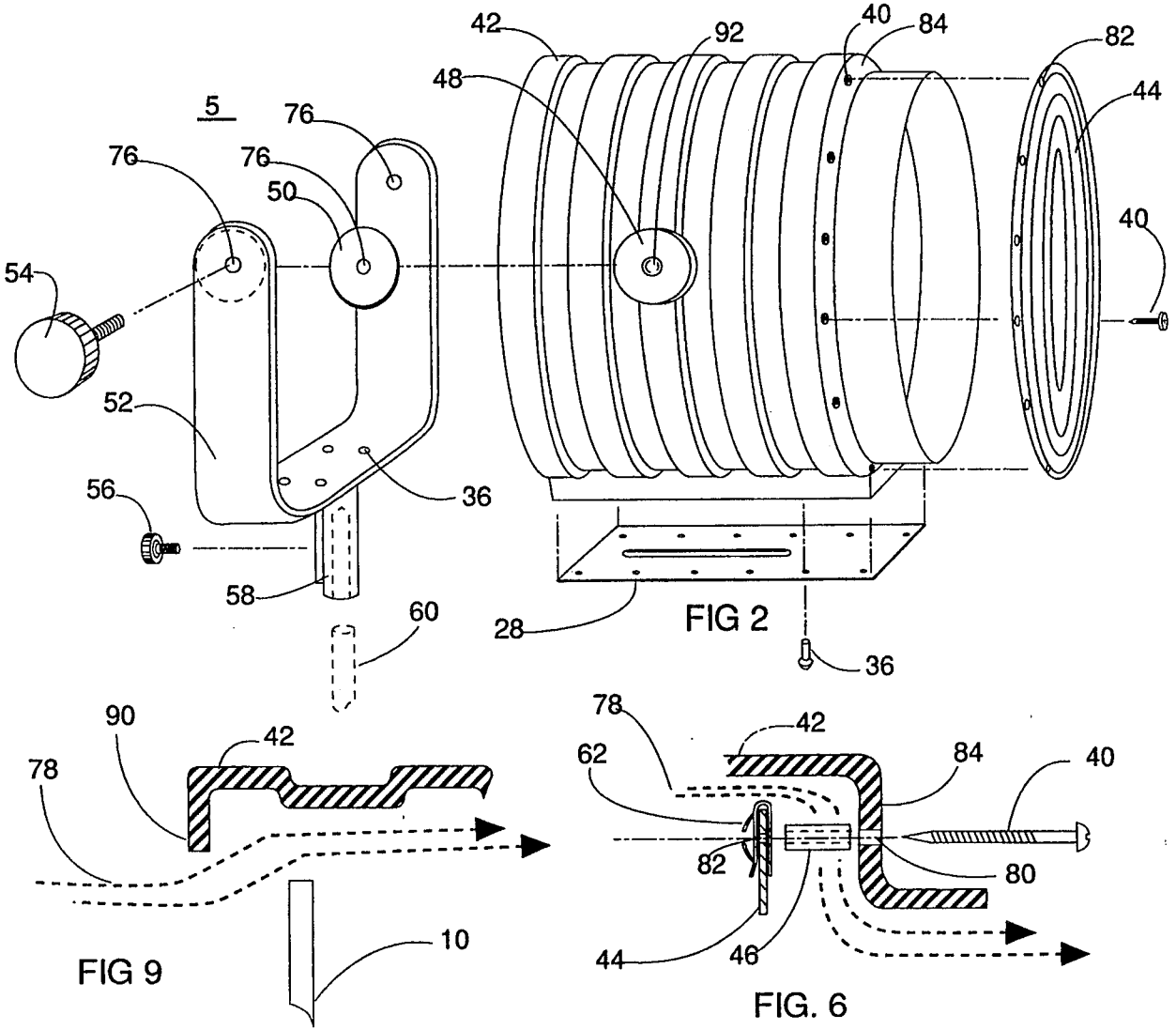
FIG. 2 is an exploded, perspective, view of the light modifier showing the relationship of its component parts, normally visible from outside.
FIG. 6 is detailed section of the method of attaching the lens to the housing front flange.
FIG. 9 shows the cross sectional relationship between the light-baffle plate and the rear flange of the housing.

FIG. 2 shows an exploded, perspective view of the modifier 5. The yoke 52 is formed of light alloy, plastic or fiber glass, and drilled with two clearance holes 76 for vertical adjustment knobs 54. The partially visible yoke attachment receiver 58 is fastened to the yoke 52 by fasteners 36, or it may be cast or molded as an integral part of the yoke assembly. The two vertical adjustment knobs 54 govern the rotational vertical (tilting) adjustment of the modifier 5, while the horizontal adjustment knob 56 enables the modifier 5 to rotate horizontally. The rubber pressure washer 50 is placed between the yoke 52 and the hub pressure plate 48. When the knob 54 is screwed into threaded hole 92 and tightened, the washer 50 compresses between hub pressure plate 48 and the yoke 52, to hold the desired setting. The lens 44 is drilled along the edges and U-nuts 62 are centered over the holes 82. The lens assembly is explained in greater detail under FIG. 6.

Figure 3:
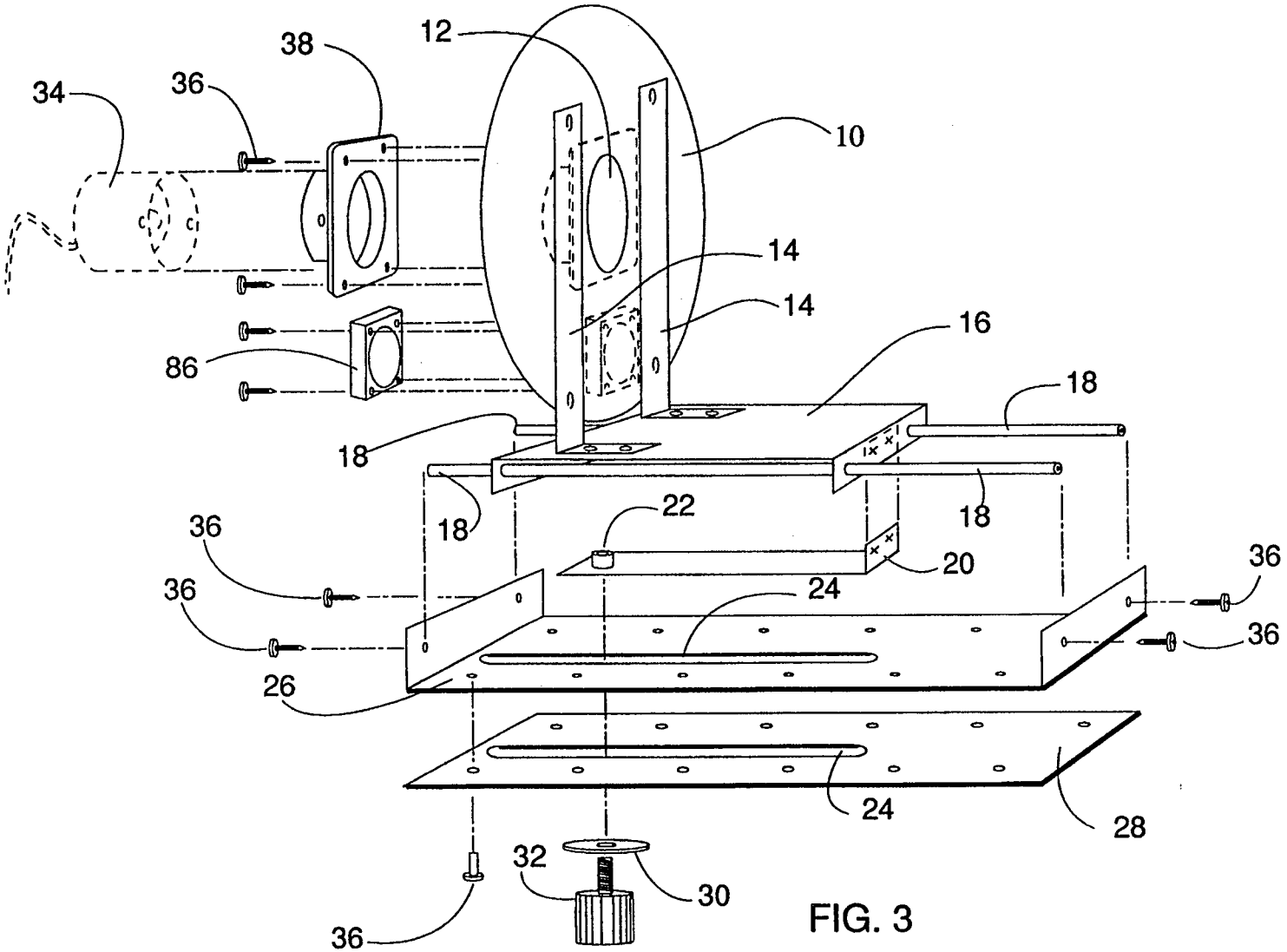
FIG. 3 is an exploded, perspective, view showing the relationship of its internal components.

FIG. 3 shows an exploded, perspective view of the internal components of the modifier 5. The purpose of the light-baffle plate 10, which is slightly smaller than the inside diameter of the housing 42 (see FIG. 9 for details) is to prevent light from spilling from the open back of the housing 42 and to allow for free air flow between the inner wall of the housing 42 and the edge of the light-baffle plate 10. It also provides a platform for mounting the light adapter plate 38. The combined modeling/strobe light source 34 is fastened to the light-baffle plate 10 by fasteners 36. These modeling light/-strobe units 34 are made by several manufacturers and are similar in operation and size. The light-baffle plate 10 is fastened to the carriage plate 16 by means of brackets 14, and slides longitudinally on the two traverse rods 18. These rods are in turn fastened on both ends to the inside base plate 26 by means of fasteners 36. The brake plate 20 is riveted or spot welded to the carriage plate 16 as shown. A weld-nut 22, with inside threads, is welded into the brake plate 20. An auxiliary fan 86 may be mounted on the light-baffle plate 10 with fasteners 36.

A matching traverse slot 24 is cut through the housing 42, which is sandwiched between the inside and outside base plates, 26 and 28. When these three parts are fastened together, the focusing knob 32 is free to travel the full length of the slot 24 carrying with it the combined modeling/strobe light source 34. When the desired light beam adjustment is accomplished, the knob 32 is tightened, locking the adjustment in place. Further details will be covered under FIG. 5.

Figure 4A:
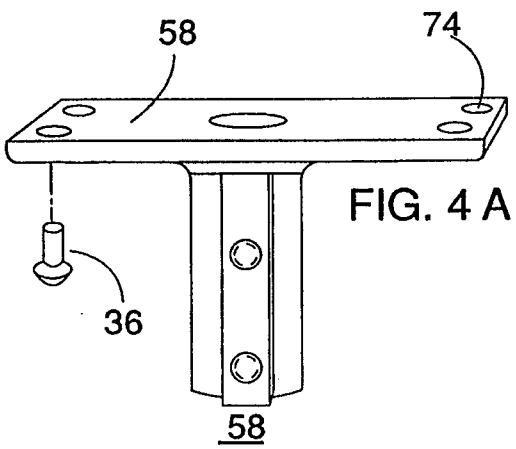
FIGS. 4A and B are detailed drawings showing the side and bottom views of the yoke attachment receiver.
Figure 4B:
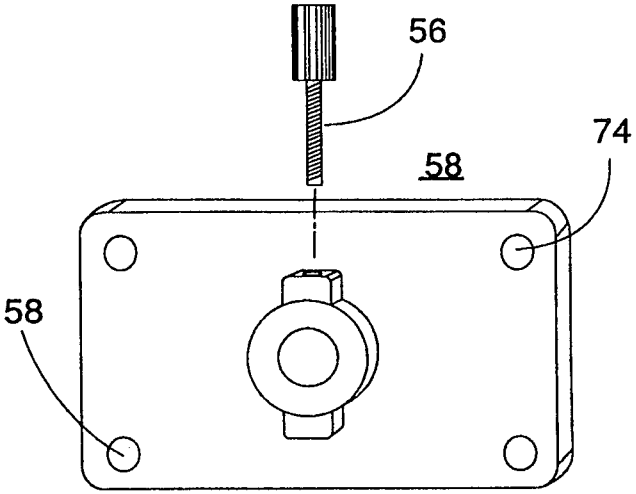

FIGS. 4A and B shows the details of the yoke attachment receiver 58. The four mounting holes 74 are used to fastened it to the yoke 52 by means of fasteners 36. The horizontal adjustment knob 56 secures the light modifier 5 to a stand 60 and allows rotation in horizontal plain of the light modifier 5. The receiver 58 may be made of metal alloy, molded from plastic, or cast or molded in one piece as an integral part of the yoke 52.

Figure 5:
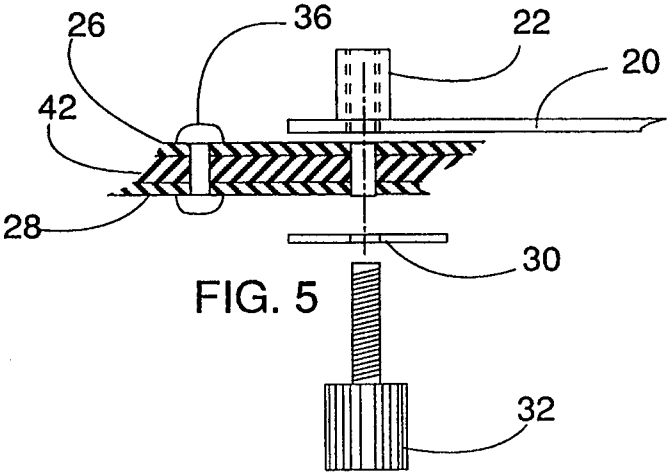
FIG. 5 features a detailed cross section, showing the relationship between the inside base plate, the plastic housing, and the outside base plate, after they are fastened together.

FIG. 5 is a sectional cut-off view showing the relationship and interaction of the brake plate 20; the brake nut 22; the inside base plate 26; the plastic housing 42; the outside base plate 28; the brake washer 30; and the brake knob 32.

The inside base plate 26, the plastic housing 42, and the outside base plate 28 are fastened together by means of fasteners 36. A common traverse slot 24 has been cut through the bottom portion of the plastic housing 42, the inside base plate 26, and the outside base plate 28. This enables the focusing knob 32 to be connected to the brake nut 22, allowing the brake plate 20, the carriage plate 16, the light-baffle plate 10, and the attached combined modeling/strobe light source 34, to traverse the full length of the traverse slot 24 as a unit.

When the focusing knob 32 is loosened but still connected to the brake nut 20, it is free to traverse the full length of the slot 24 in order to create a spot or a flood light. When the focusing knob 32 is tightened against the brake washer 30, the flexible brake plate 20 is drawn against the bottom of the inside base plate 26, thereby holding any desired setting. Light beam adjustments are made by simply loosening the focusing knob 32 and traversing as needed. When the combined modeling/-strobe light source 34 is moved toward the lens 44, the beam spreads; when moved toward the rear, the beam condenses to a spot.

FIG. 6 is a detailed illustration of the attachment of the fresnel lens 44 to the inside front flange 84. In order to allow for free air flow 78, an air gap is maintained by placing spacers 46 between the front flange 84 and the outside-facing facet side of the lens 44. The fasteners 40 are inserted, from outside of the front flange 84, through the fastener hole 80, through the housing 42, through the spacer 46, and fastened into the U-nuts 62, which are clipped over the drilled holes 82 in the lens 44.

Figure 7B:
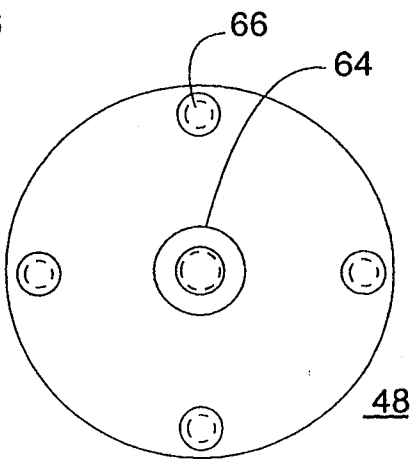
FIGS. 7A and B show cross sectional view of the hub pressure plate; the encapsulated J-nuts and the threaded weld-nut.
Figure 7A:
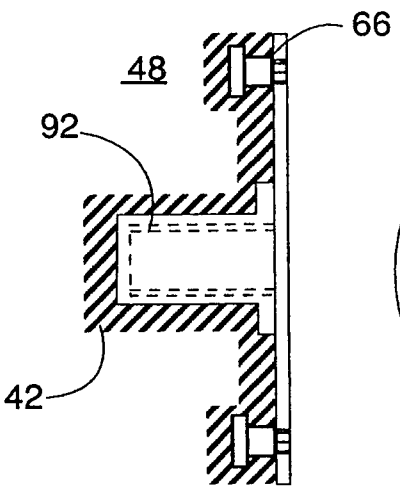

FIGS. 7A and B are detailed views of the hub pressure plate 48. It is a large metal washer with a closed-end weld nut 64 attached to its center, having threaded hole 92 for engaging the vertical adjustment knob 54. Four J-nuts 66 are equally spaced and fastened on the hub pressure plate 48 on the same side as the weld-nut 64, to provide anchor points for the plastic housing 42 to adhere. During the molding cycle, the two pressure plates 48 are inserted into the mold, one for each side, so that the molten plastic completely encapsulates the entire back side of the hub pressure plates 48, which then becomes an integral parts of the housing 42. The undercut heads of the J-nuts 66, mounted near the edges of the pressure plates 48, ensure that there is no separation of the plastic housing 42 and the pressure plates 48.

Figure 8A:
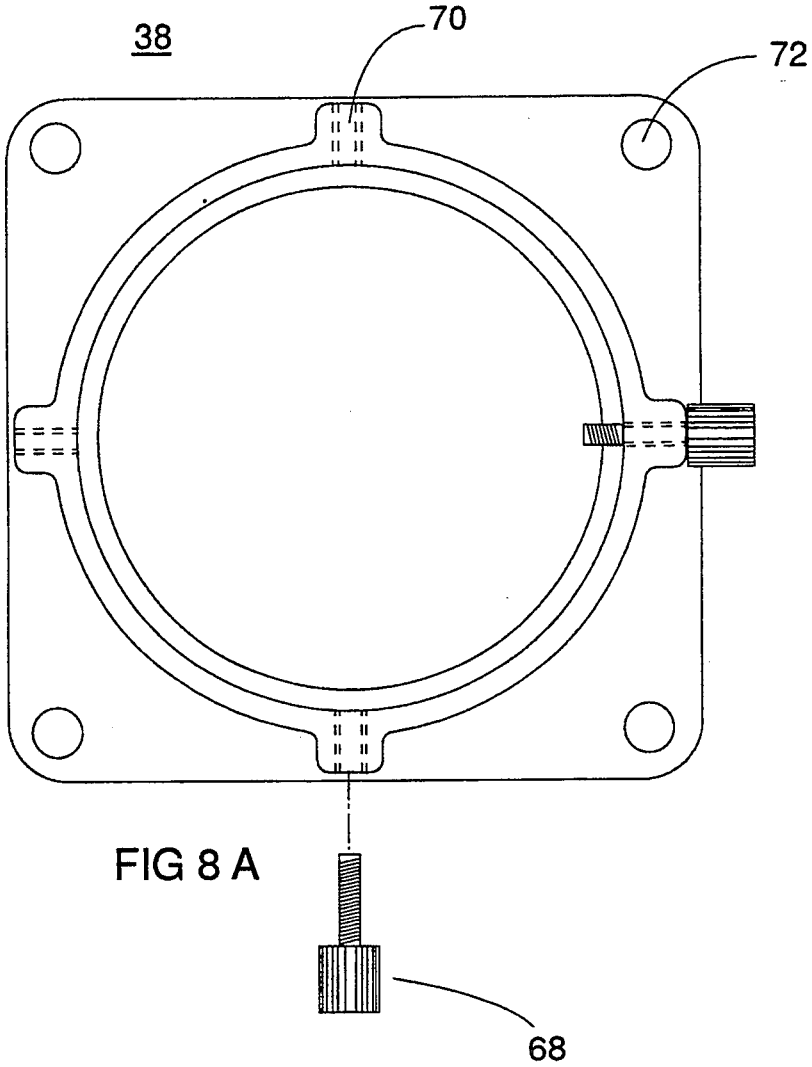
FIGS. 8A and B shows the front and side views of the of the light adapter plate.
Figure 8B:
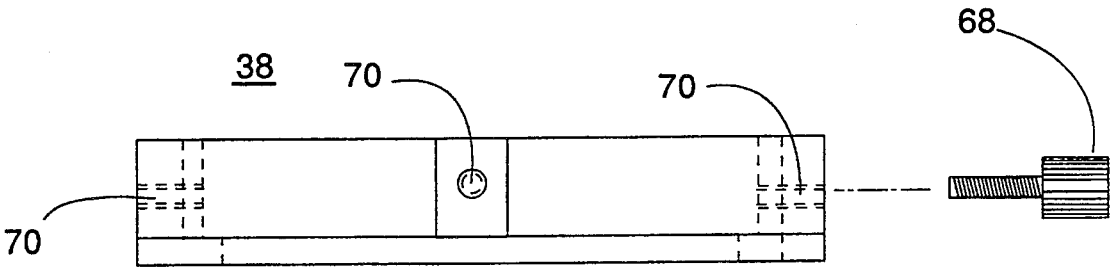

FIGS. 8A and B show the top and side views of the light adapter plate 38. Four holes 72 are drilled for attaching it to the light-baffle plate 10 with fasteners 36. The combined modeling/strobe light source 34 is held in place by pressure of the four clamping screws 68, which are threaded through tapped holes 70. The light adapter plate 38 may be fabricated or cast from metal alloy, or molded from plastic.

FIG. 9 is a cross sectional view of the relationship between the light-baffle plate 10, the housing 42, the rear flange 90, and the airlow 78. The light-baffle plate 10 is slightly smaller than the rear flange 90 opening for free air flow 78 to take place, while preventing nearly all light from escaping.

Accordingly, the objects and advantages of this invention are:

To replace the current heavy metal housing and cumbersome glass fresnel lens with lightweight plastics resulting in weight and cost reduction.

To increase the size of the lens resulting in additional light output and more uniform distribution, for a given light source.

To utilize a molding process which frees the design from severe limitations imposed by the two-dimensional nature of sheet metal. For example, the transition from circular to straight edges around the hub pressure plate or the flat bottom portion of the unit are easily molded in place and the shape of the light modifier housing, with its circumferential rib construction adds to the strength of the design.

To utilize a lighter support yoke and subsequent use of lighter support structure. The resulting weight reduction and added strength makes it easier to ship and transport the light modifier to a location.

To allow for an open ended construction, both front and back, which means that no additional ventilation is required under normal use. The air is free to circulate around the rear light-baffle plate and the spacer mounted lens.

To eliminate the need for painting or additional finishing. The plastic housing is resistant to dents, and because the color is part of the plastic, it does not readily show abrasions or scratches.

The above description covers, in general terms, the present invention without limiting the full scope of the invention to these specifics. For example, the general shape of the light modifier, presently illustrated and described as cylindrical, may be made rectangular. The lens can just as easily be square or rectangular in shape. An auxiliary fan 86 may be employed to cool off the light-housing interior in an unusually heavy use or when the ambient temperature requires additional venting.

Any number of accessories such as barn doors, louvers, grids and gel filters may be attached to the unit to direct and enhance the light.

The improved light modifier 5 has been described with reference to a particular embodiment. However, it should be obvious to those skilled in the art to which this invention pertains that other modifications and enhancements can be made without departing from the spirit and scope of the claims that follow.

What is claimed:

1. A light modifier of the type using a combined modeling/strobe light source for illumination and capable of being mounted on a stand comprising:

(a) a hollow plastic housing having a longitudinal axis, an open front, an open rear, an inside, and an outside;

(b) a light carrier slidably mounted inside said hollow plastic housing so that said light carrier can move parallel to said longitudinal axis; said carrier being adapted to detachably receive said combined modeling/strobe light source so that light is projected in a direction parallel to said longitudinal axis;

(c) a plastic fresnel lens, having a smooth, frosted side facing the inside light source and a faceted side facing the outside, detachably mounted near said open front, inside said hollow plastic housing, and perpendicular to said longitudinal axis so as to allow air flow between said plastic fresnel lens and said hollow plastic housing;

(d) a light-baffle plate, slightly smaller than said hollow plastic housing in order to allow free air circulation between said light-baffle plate and said hollow plastic housing, attached to said light carrier so that light is essentially prevented from escaping from said open rear;

(e) means for securing said light carrier at a desired location within said hollow plastic housing; said means for securing being accessible from outside;

(f) means for mounting said hollow plastic housing on said stand; and (g) means for adjusting the angle of said longitudinal axis relative to said stand (h) means for securing said longitudinal axis at a particular horizontal rotational angle relative to said stand.

2. A light modifier as claimed in claim 1 in which said hollow plastic housing includes circumferential ribs.

3. A light modifier as claimed in claim 1 in which said fresnel lens is frosted.

4. A light modifier as claimed in claim 3 in which said frosting is achieved by mechanical means.

5. A light modifier as claimed in claim 3 in which said frosting is achieved by chemical methods.

6. A light modifier as claimed in claim 1 in which:

(a) said means for mounting said hollow plastic housing on said stand, (b) said means for adjusting the angle of said longitudinal axis relative to said stand and (c) said means for securing said longitudinal axis at a particular horizontal rotational angle relative to said stand are fabricated from material selected from the group consisting of metal, plastic, fiberglass reinforced composite and their combinations.

7. A light modifier as claimed in claim I in which said plastic fresnel lens is mounted by mechanical fasteners.

8. A light modifier as claimed in claim 1 in which said hollow plastic housing is a one-piece molding.

9. A light modifier as claimed in claim 1 in which said hollow plastic housing is a multi-piece molding.

10. A light modifier as claimed in claim 1 in which light modifier also includes an auxiliary cooling fan.

11. A light modifier as claimed in claim 1 in which said means for adjusting includes an encapsulated metal hub pressure plate integral with said hollow plastic housing.

* * * * *